US006854866B1

(12) United States Patent
Liang

(10) Patent No.: US 6,854,866 B1
(45) Date of Patent: Feb. 15, 2005

(54) LIFT ADJUSTING MODULE

(75) Inventor: Jyh-Wei Liang, Taoyuan (TW)

(73) Assignee: Mediline Enterprise Corporation, Taoyuan Hsien (TW)

( * ) Notice: Subject to any disclaimer, the term of this patent is extended or adjusted under 35 U.S.C. 154(b) by 0 days.

(21) Appl. No.: 10/654,439

(22) Filed: Sep. 4, 2003

(51) Int. Cl.[7] ..... F21V 33/00
(52) U.S. Cl. ..... 362/399; 362/33; 362/804
(58) Field of Search ..... 362/289, 400, 362/33, 109, 399, 804; 16/DIG. 24, DIG. 41, 903

(56) References Cited

U.S. PATENT DOCUMENTS 4,878,156 A * 10/1989 Hallings et al. ..... 362/399
4,916,597 A * 4/1990 Hallings et al. ..... 362/804
6,402,351 B1 * 6/2002 Borders et al. ..... 362/804

* cited by examiner

*Primary Examiner*—Y My Quach Lee
(74) *Attorney, Agent, or Firm*—Birch, Stewart, Kolasch & Birch, LLP

(57) ABSTRACT

A lift adjusting module is located in a surgical operation lamp and includes a plurality of latch elements to movably latch on petal sections of a brake piece. The brake piece runs through a rotary member and a rotary shaft. When a handle receives force, the rotary member drives the rotary shaft and moves a lamp seat axially to control the projection focus scope of the operation lamp. In the mean time, the latch elements are compressed and selectively embedded in the rotary member to effectively prevent the operation lamp from wearing and being damaged due to improper force. Thus surgical operation safety may be enhanced and the service life of the operation lamp can be increased.

9 Claims, 6 Drawing Sheets

LIFT ADJUSTING MODULE

FIELD OF THE INVENTION

The invention relates to a lift adjusting module adopted for use on medical illumination systems and particularly to a lift adjusting module to prevent surgery operation lamps from being damaged by improper handling.

BACKGROUND OF THE INVENTION

The advance of modern technologies has created increasing health care awareness for many people. To increase life expectancy is a widely pursued goal. However, accidental injury or illness is unavoidable to human beings. Some of the illnesses have to be treated by surgical operations. The environment for doctors to perform surgery operation is very important. Without a proper operation environment even doctors with excellent medical skills and expertise cannot achieve the desired results. In most operation environments, the operation lamp is a critical item, but is often neglected.

The surgical operation environment generally is not very desirable. During surgical operations, doctors have to perform delicate operations in a very limited space within a patient's body. Successful operation and treatment, aside from luck and skill of the doctors, heavily depends on the physical endurance and concentration of the doctors.

With proper aid of operation lamps, desired illumination and focus scope may be dynamically controlled to enable doctors to perform delicate operations whether in a large scope or a small scope. It helps doctors to reduce physical labor and better concentrate on the surgical operation.

General products now available on the market mostly have a movable handle installed below the operation lamp. Control of light projecting scope is achieved by lifting or lowering the lamp seat by turning the handle. Conventional operation lamps generally have an integrated long shaft connecting to the tamp seat to generate up and down movement and adjust the projecting scope. However, during surgical operations, if surgical position changes the projecting scope also has to be changed. If the operation lamp has a limited projecting scope, projection focus scope must be adjusted by moving and turning the handle. As doctors usually are in a highly concentrated condition during surgical operations, they tend to turn the handle incessantly without noticing that the adjustment limit has been reached. As a result, the control mechanism of the operation lamp has excessive wearing or is even damaged. Adjustment with excessive force is the main reason for damage of the mechanism. The surgical operation lamp is an expensive article. Damage of the control mechanism of the illumination apparatus not only reduces the service life of the operation lamp, it also increases repairs and maintenance cost of the lamp set. In serious situations, breakdown of the operation lamp could result in delay of a surgical operation and put a patient's life at risk.

The aforesaid problems have occurred to the conventional operation lamps for a long time and remain to be resolved.

SUMMARY OF THE INVENTION

In view of the aforesaid disadvantages, the primary object of the invention is to provide a lift adjusting module to remind users when the limit of adjustment range has been reached, and prevent the operation lamp from wearing or damaging and achieve safe surgical operations.

The lift adjusting module of the invention discards the integrated design of conventional control mechanisms. It separates the illumination control rotary shaft from the rotary member. A novel brake piece is provided to couple with latch elements and run through the rotary member and fasten to the rotary shaft. When users turn the handle and the limit of adjustment range is reached, the latch elements may be selectively embedded in the rotary member to separate the coupling relationship between the rotary member and the rotary shaft and generate idle rotation. When rotation continues, the latch elements are moved among a plurality of petal sections on the brake piece to generate a clicking sound. Therefore users can easily recognize that the limit of adjustment range has been reached, and wearing or damage may be prevented.

According to the lift adjusting module of the invention, a separated rotary shaft and rotary member are used. A brake piece is provided to couple with a plurality of latch elements and generate chained movements. When the handle receives turning force to adjust the focus scope of projection, the latch elements may be selectively embedded in the rotary member to prevent the rotary member from continuously driving the rotary shaft and causing wear or damage to the operation lamp. It also can ensure the safety of surgical operations. The dimensions may be altered to match other types of handles on the market, such as disposable handles or the like, and provide versatile options.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
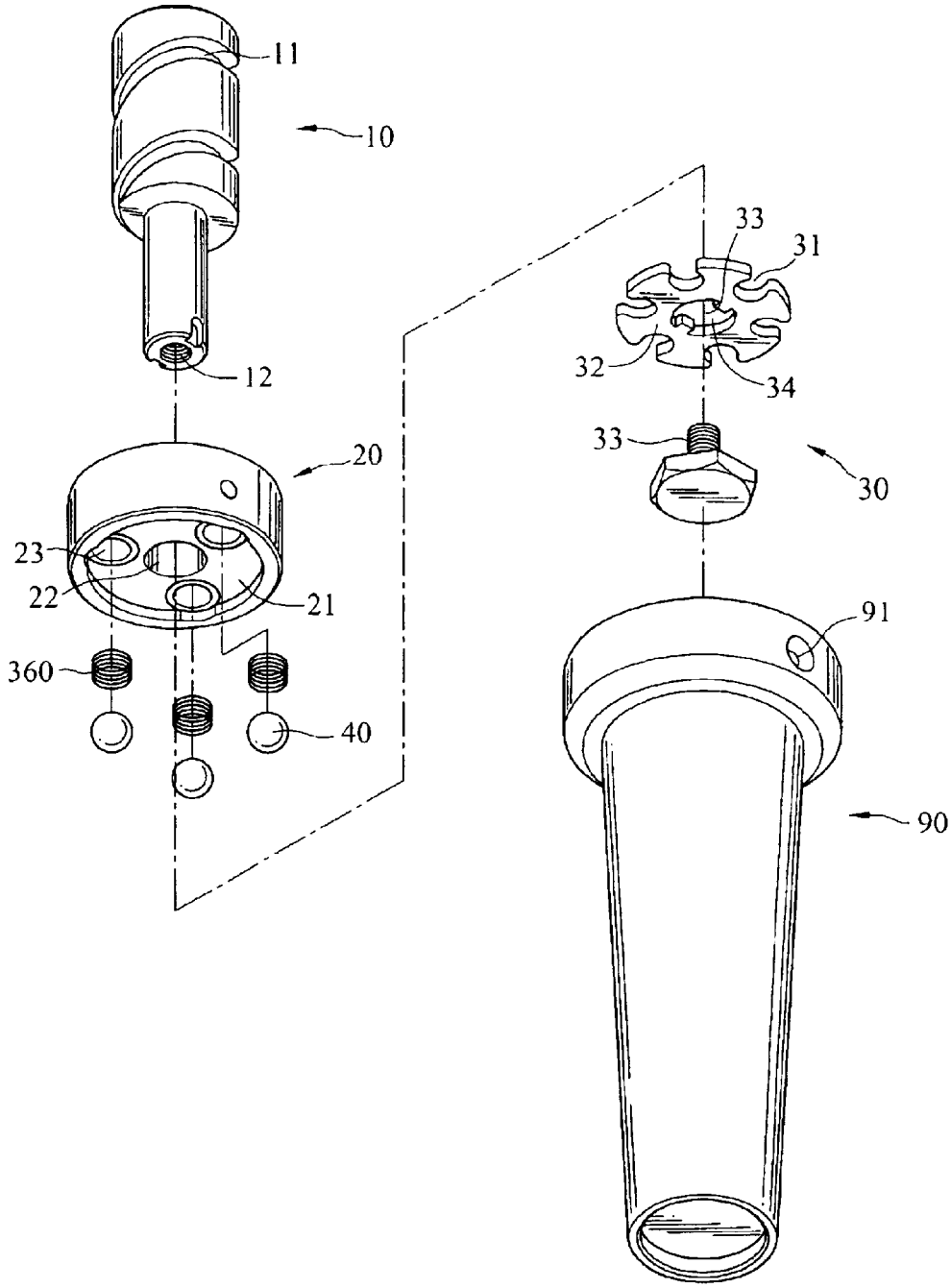
FIG. 1 is a perspective view of the lift adjusting module of the invention.

The lift adjusting module of the invention mainly aims to avoid wear and damage of operation lamps, increase their service life, and improve operation safety. Referring to FIG. 1, the lift adjusting module of the invention mainly includes a rotary shaft 10, a rotary member 20, a brake piece 30, a plurality of latch elements such as rolling balls 40, and a handle 90. The rotary shaft 10 has helical grooves 11 formed on the outer surface thereof. It has one end forming an aperture 12. The rotary member 20 has one end forming a recess 21, which has a through opening 22 in the center and a plurality of cavities 23 around the through opening 22. The brake piece 30 has a plurality of anchor holes 31 to divide the brake piece 30 into a plurality of petal sections 32. A fastener 33 is provided to run through the brake piece 30. It may be a bolt with screw threads formed on the outer surface.

Figure 2:
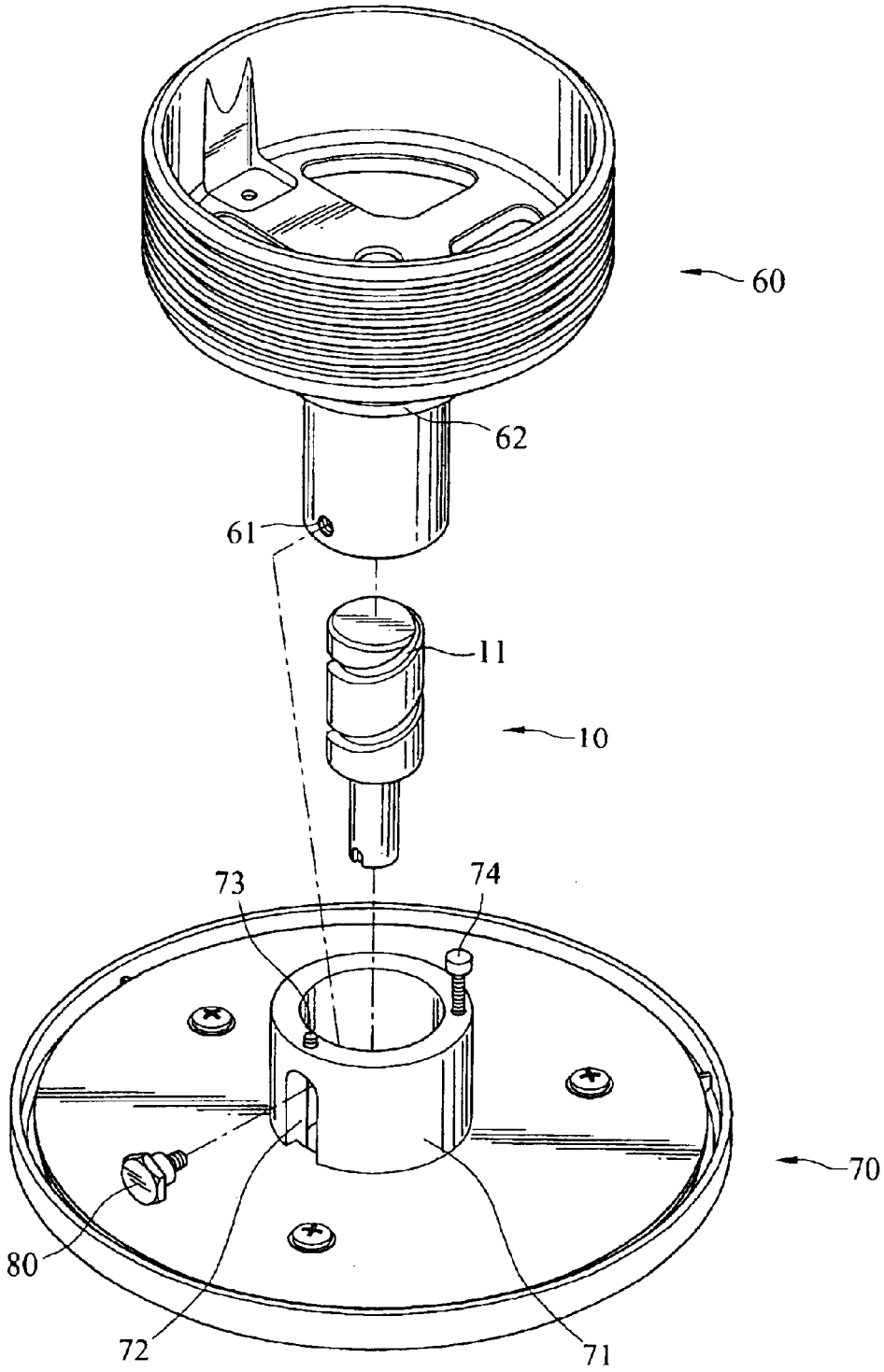
FIG. 2 is a schematic view of a lamp seat of the lift adjusting module of the invention.

Refer to FIG. 2 for the lamp seat of the invention. The lamp seat 60 includes a stopping plate 62 and an axle with a fastening hole 61 formed thereon. A loading dock 70 is provided with a hollow sleeve lining 71. The sleeve lining has a top edge coupled with an upper bucking screw 73, which is extended for a selected distance, a trough 72 formed on one side of the sleeve 71, and a lower bucking screw 74 located on one end spaced from the trough 72. For coupling the rotary shaft 10 with the lamp seat 60 and their movements, first, a set crew 80 is used to run through the trough 72 and the fastening hole 61 of the lamp seat 60 to engage with the helical groove 11 of the rotary shaft 10. When the rotary shaft 10 rotates, the set screw 80 is moved upwards or downwards in the helical groove 11, and drives the lamp seat 60 up or down for a desired displacement. The upper bucking screw 73 and the lower bucking screw 74 may limit the range of motion of the lamp seat 60.

Figure 3:
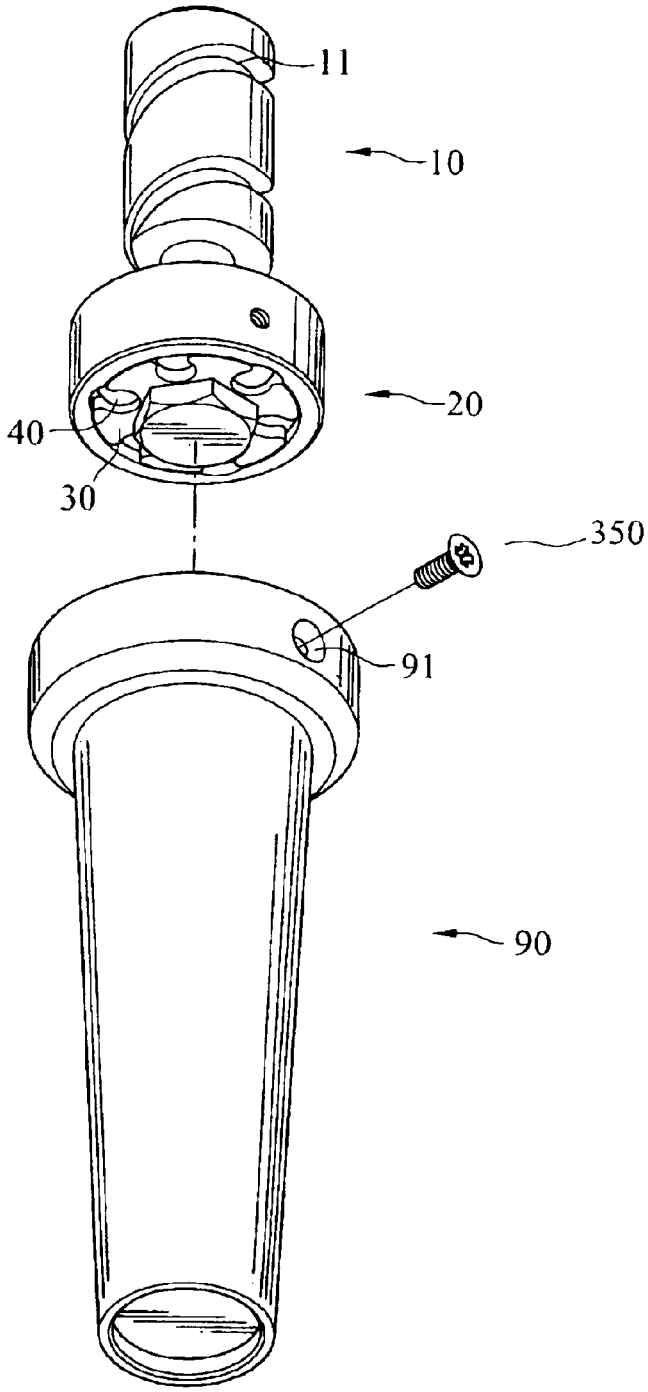
FIG. 3 is a schematic view of the rotary member assembly of the invention.

For coupling the rotary shaft 10 with the rotary member 20 and their movements, refer to FIGS. 1 and 3. First, springs 360 are provided and disposed in the cavities 23 of the rotary member 20 to provide compression pressure on the rolling balls 40 so that the rolling balls 40 are housed in cavities 23 but are exposed outside in normal conditions. Next, a fastener 33 is used to run through an opening 34 of the brake piece 30 and the through opening 22 of the rotary member 20, and engage with the aperture 12 of the rotary shaft 10. Of course, the aperture 12 has screw threads formed on its inner surface to match and engage with the fastener 33. A screw 350 is used to run through a fastening hole 91 formed on the handle 90 to fasten the rotary member 20 to the handle 90. Thereby an external force may be applied on the handle for turning.

Figure 4B:
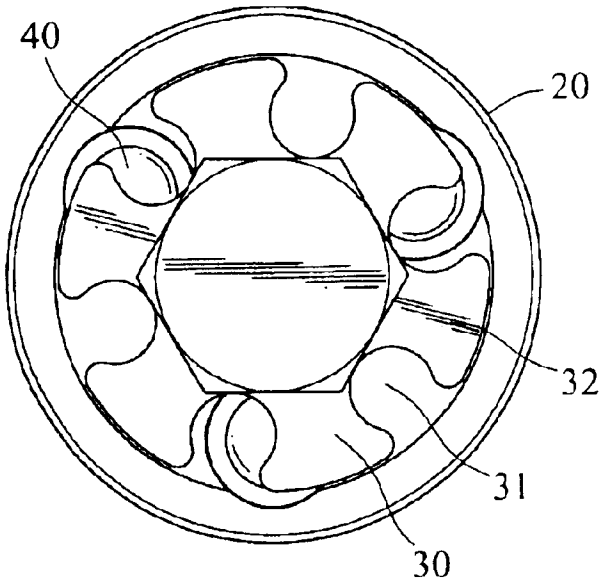
FIGS. 4A and 4B are schematic views of the brake piece of the invention in operating conditions.
Figure 4A:
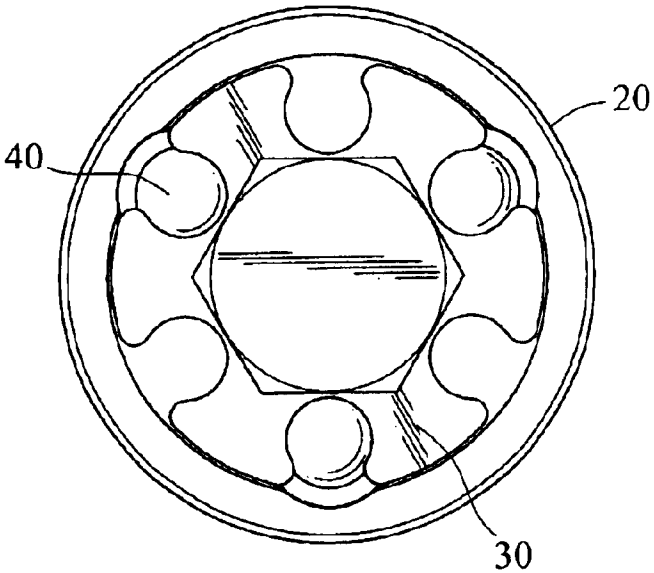
Figure 5A:
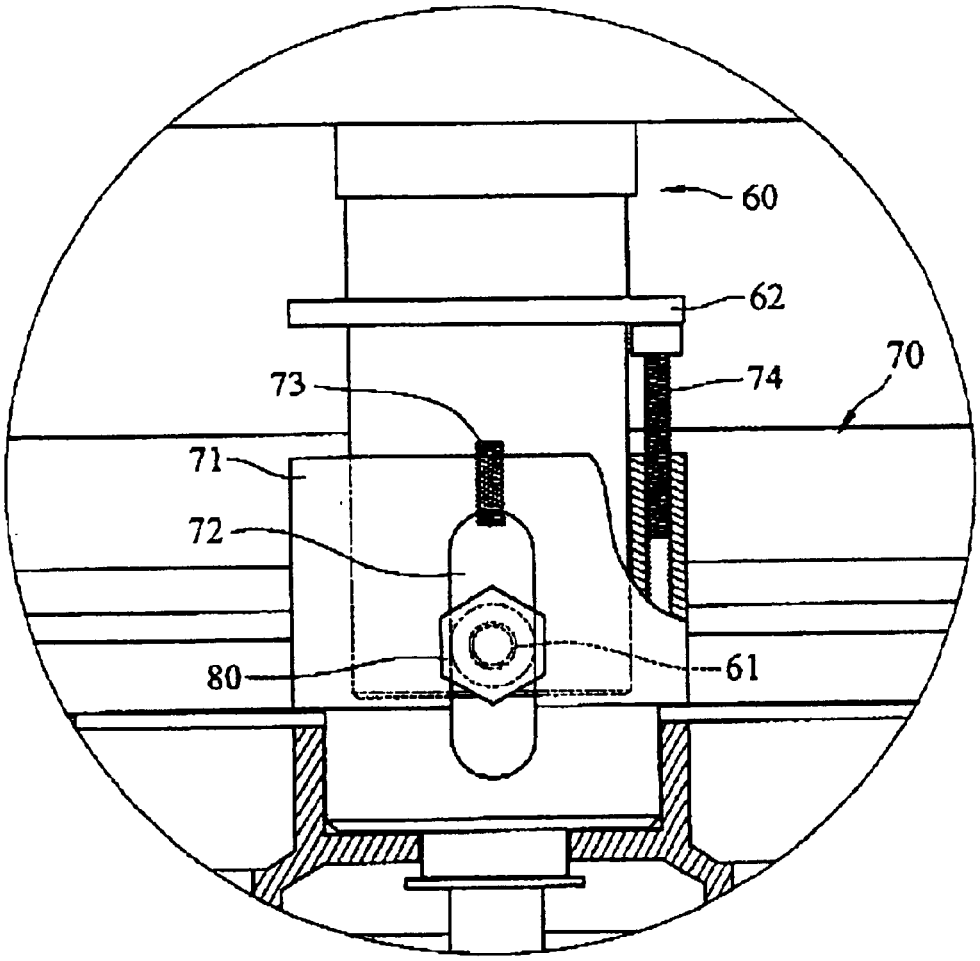
FIG. 5A is a schematic view of the lamp seat at the lower dead point of the movable range.
Figure 5B:
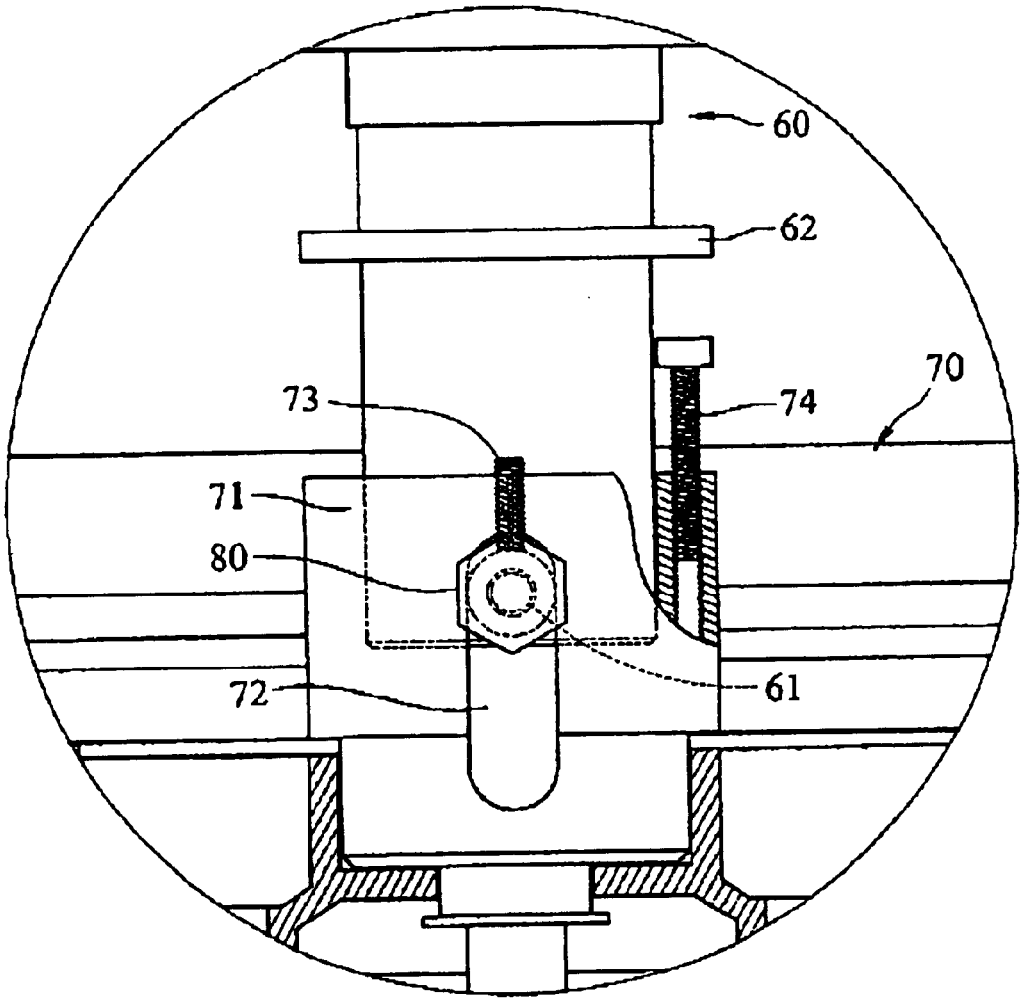
FIG. 5B is a schematic view of the lamp seat at the upper dead point of the movable range.

Refer to FIGS. 4A and 4B for the brake piece of the invention in operation. When the handle 90 receives force and drives the rotary member 20 to rotate, the rolling balls 40 are held in the anchor holes 31 of the brake piece 30, and the rotary shaft 10 is driven to rotate, thereby the lamp seat 60 is moved upwards or downwards axially to adjust the projection focus scope of the operation lamp. As shown in FIGS. 4A, 5B, when the fastening hole 61 of the lamp seat 60 reaches the upper bucking screw 73, the set screw 80 would be against to the upper bucking screw 73, and it is at the upper dead point of the movable range. As shown in FIGS. 4B, 5A, when the stopping plate 62 of the lamp seat 60 reaches and is against the lower bucking screw 74, it is at the lower dead point of the movable range. If users continuously exert force, the rolling balls 40 are compressed by the brake piece 30 to sink inside the cavities 23, while the rotary member 20 continues to receive the external force and rotate, but the rotary shaft 10 does not rotate and an idle rotation occurs. In the mean time, the rolling balls 40 latch onto the anchor holes 31 repeatedly and generate a clicking sound to remind users that the adjusting movement has exceeded the adjustable projection focus scope. Thereby element wearing or damage may be effectively prevented.

The lift adjusting module of the invention employs a separated rotary shaft 10 and rotary member 20, and uses a brake piece 30 to couple with a plurality of latch elements 40 to generate chained movements. When the handle 90 receives force to adjust the projection focus scope, the latch elements 40 may be selectively embedded in the rotary member 20 to prevent the operation lamp from wearing or being damaged by continuous rotation of the rotary member 20 and the rotary shaft 10. Therefore, not only will the service life of the operation lamp increase, but the safety of surgical operation can also be secured. The dimensions of the invention may be altered to fit other types of handles on the market such as disposable handles. Thus the lift adjusting module of the invention may be matched to many different handle products to avoid wearing and damage, and provide versatile selections.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A lift adjusting module adopted for use on a lamp seat of a surgical operation lamp to control the projection scope of the surgical operation lamp, comprising:

a rotary shaft coupled to one side of the lamp seat;

a rotary member coupled to said rotary shaft and having a plurality of cavities;

at least one latch element housed in the cavities and pressed by the compression force of an elastic element being exposed outside the rotary member in normal conditions;

a brake piece located on one side of the rotary shaft having a plurality of anchor holes; and a handle fastened to the rotary member for receiving external forces;

wherein the brake piece is connected to the rotary member and the rotary shaft, the rotary shaft being driven by the rotary member through latching of the latching element in the anchor holes such that when handle is turned by a force the rotary shaft is turned to allow the lamp seat to generate an axial movement in a range of an upper dead point and a lower dead point, the latch element being compressed by the brake piece to sink into the cavities of the rotary member to prevent the rotary member from driving the rotary shaft thereby to avoid the surgical operation lamp from wearing and damaging under continuous presence of the force.

2. The lift adjusting module of claim 1, wherein the rotary member has one end forming a recess for housing the brake piece.

3. The lift adjusting module of claim 1, wherein the rotary member has a through opening in a center.

4. The lift adjusting module of claim 3 further having a fastener running through an opening of the brake piece and the through opening of the rotary member to fasten the brake piece to the rotary shaft.

5. The lift adjusting module of claim 4, wherein the fastener is a bolt.

6. The lift adjusting module of claim 5, wherein the rotary shaft has one end forming an aperture which has screw threads on an inner surface to match the bolt to allow the bolt to engage with the rotary shaft.

7. The lift adjusting module of claim 4, wherein the opening of the brake piece is formed in a center thereof.

8. The lift adjusting module of claim 1, wherein the latch element is a rolling ball.

9. The lift adjusting module of claim 1, wherein the elastic element is a spring.

* * * * *